US008923543B2

(12) United States Patent
Sacha et al.

(10) Patent No.: US 8,923,543 B2
(45) Date of Patent: Dec. 30, 2014

(54) HEARING ASSISTANCE DEVICE VENT VALVE

(71) Applicant: Starkey Laboratories, Inc., Eden Prairie, MN (US)

(72) Inventors: Michael Karl Sacha, Chanhassen, MN (US); David Tourtelotte, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/720,793

(22) Filed: Dec. 19, 2012

(65) Prior Publication Data

US 2014/0169603 A1 Jun. 19, 2014

(51) Int. Cl.
*H04R 25/00* (2006.01)

(52) U.S. Cl.
CPC ..... *H04R 25/60* (2013.01); *H04R 25/305* (2013.01); *H04R 25/405* (2013.01); *H04R 25/456* (2013.01); *H04R 25/552* (2013.01); *H04R 25/554* (2013.01); *H04R 25/652* (2013.01); *H04R 25/658* (2013.01); *H04R 25/70* (2013.01); *H04R 2225/31* (2013.01); *H04R 2225/61* (2013.01); *H04R 2460/03* (2013.01); *H04R 2460/11* (2013.01)
USPC ..... 381/324; 381/322; 381/328; 181/135

(58) Field of Classification Search
CPC ..... H04R 2460/11; H04R 25/456; H04R 25/658; H04R 25/652; H04R 2225/023
USPC ..... 381/328, 322, 324; 181/135
See application file for complete search history.

(56) References Cited

U.S. PATENT DOCUMENTS

| | | | | |
|---|---|---|---|---|
| 2,754,365 | A | 7/1956 | Walters et al. | |
| 3,702,123 | A | 11/1972 | Macken et al. | |
| 5,033,090 | A * | 7/1991 | Weinrich | 381/318 |
| 5,984,269 | A * | 11/1999 | Short et al. | 251/305 |
| 6,549,635 | B1 * | 4/2003 | Gebert | 381/324 |
| 6,819,770 | B2 * | 11/2004 | Niederdrank | 381/322 |
| 8,391,527 | B2 * | 3/2013 | Feucht et al. | 381/328 |
| 2011/0129108 | A1 | 6/2011 | Miller et al. | |

FOREIGN PATENT DOCUMENTS

| | | | | |
|---|---|---|---|---|
| FR | 2504233 A | * 10/1982 | | F16K 1/226 |
| WO | WO-2010042613 A2 | 4/2010 | | |

* cited by examiner

*Primary Examiner* — Curtis Kuntz
*Assistant Examiner* — Ryan Robinson
(74) *Attorney, Agent, or Firm* — Schwegman Lundberg & Woessner, P.A.

(57) ABSTRACT

Techniques are disclosed for actuating a valve of a hearing assistance device. In one example, a hearing assistance device comprises a device housing defining a vent structure, a vent valve positioned within the vent, the vent valve having first and second states. The vent valve comprises a magnet, a disk configured to move about an axis, and a magnetic catch. The hearing assistance device further comprises an actuator, and a processor configured to provide at least one signal to the actuator to cause the disk to move to controllably adjust the vent structure.

20 Claims, 11 Drawing Sheets

HEARING ASSISTANCE DEVICE VENT VALVE

TECHNICAL FIELD

The disclosure relates generally to hearing assistance devices and, more particularly, to hearing assistance devices that include vents.

BACKGROUND

A hearing assistance device may fill a user's ear canal. Depending on the frequencies at which the user experiences hearing loss, the user may experience an "occlusion effect" as a result of the filled ear canal. Normal activities, such as chewing and talking, can result in vibrations that are reflected back to the eardrum due to the occluded ear canal. A user can perceive these reflected vibrations as unwanted hollow sounds. As a result, hearing assistance devices, e.g., hearing aids, can include a vent in the device earmold to allow vibrations to pass through the ear canal and reduce or eliminate the occlusion effect. The vent, however, can negatively affect the performance of the hearing assistance device. For instance, at certain frequencies the vent can cause feedback, which can result in a high-pitched squeal. As such, a vent valve can be included in the hearing assistance device and can be opened or closed as needed to improve the user's listening experience. Also, by closing the vent, streamed music, for example, may have a better low frequency response. This feature combined with other signal processing techniques can enhance the user's experience.

SUMMARY

In general, this disclosure describes techniques for holding a vent valve of a hearing assistance device, e.g., hearing aid, in an open or closed position without consuming power. More particularly, using various techniques of this disclosure, a self-balancing valve, e.g., a butterfly valve, can be included within the vent of the hearing assistance to reduce the power consumption of the device.

In one example, this disclosure is directed to a hearing assistance device for providing sound to an ear canal of a user, comprising a device housing configured to be worn at least partially in the ear canal of the user, the device housing defining a vent structure extending from a first portion of the housing to a second portion of the housing to provide an acoustic path for sounds to pass through the device. The hearing assistance device further comprises a vent valve positioned within at least a portion of the vent structure, the vent valve having at least a first state and a second state, the vent valve comprising a magnet having a magnetic field, a disk configured to move about an axis, and a magnetic catch configured to apply a force to the disk to hold the disk in at least one of the first state and the second state. The hearing assistance device further comprises an actuator and a processor configured to provide at least one signal to the actuator to cause the disk to move to controllably adjust the vent structure.

In another example, this disclosure is directed to a method for providing sound to an ear canal of a user that comprises providing a hearing assistance device, the hearing assistance device comprising a device housing configured to be worn at least partially in the ear canal of the user, the device housing defining a vent structure extending from a first portion of the housing to a second portion of the housing to provide an acoustic path for sounds to pass through the device. The hearing assistance device further comprises a vent valve positioned within at least a portion of the vent structure, the vent valve having at least a first state and a second state, the vent valve comprising a magnet having a magnetic field, a disk configured to move about an axis, and a magnetic catch configured to apply a force to the disk to hold the disk in at least one of the first state and the second state. The hearing assistance device further comprises an actuator and a processor configured to provide at least one signal to the actuator to cause the disk to move to controllably adjust the vent structure. The method further comprises providing the at least one signal to the actuator to cause the disk to move to controllably adjust the vent structure and holding the valve in the first state or the second state, via the magnetic catch.

In another example, this disclosure is directed to a hearing assistance device comprising a device housing configured to be worn at least partially in the ear canal of the user, the device housing defining a vent structure extending from a first portion of the housing to a second portion of the housing to provide an acoustic path for sounds to pass through the device. The hearing assistance device further comprises a vent valve positioned within at least a portion of the vent structure, the vent valve having at least a first state and a second state, the vent valve comprising a magnet having a magnetic field, a disk, a disk axle about which the disk is configured to rotate, a valve housing, and a magnetic catch. The hearing assistance device further comprises a coil disposed adjacent the valve housing, and a processor configured to control application of at least one signal to the coil, where the application of the at least one signal to the coil produces a coil polarization that interacts with the magnetic field of the magnet and causes the disk to rotate about the disk axle, and where the magnetic catch is configured to hold the valve, via the magnet, in the first state or the second state.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and examples in which the present subject matter may be practiced. These examples are described in sufficient detail to enable those skilled in the art to practice the present subject matter. References to "an", "one", or "various" examples in this disclosure are not necessarily to the same example, and such references contemplate more than one example. The following detailed description is demonstrative and not to be taken in a limiting sense. The scope of the present subject matter is defined by the appended claims, along with the full scope of legal equivalents to which such claims are entitled.

The present detailed description discusses hearing assistance devices using the example of hearing aids. Hearing aids, however, are only one type of hearing assistance device. Other hearing assistance devices include, but are not limited to, those in this document. Hearing assistance devices include, but are not limited, ear level devices that provide hearing benefit. One example is a device for treating tinnitus. Another example is an ear protection device. Possible examples include devices that can combine one or more of the functions/examples provided herein. It is understood that their use in the description is intended to demonstrate the present subject matter, but not in a limited or exclusive or exhaustive sense.

Figure 1:
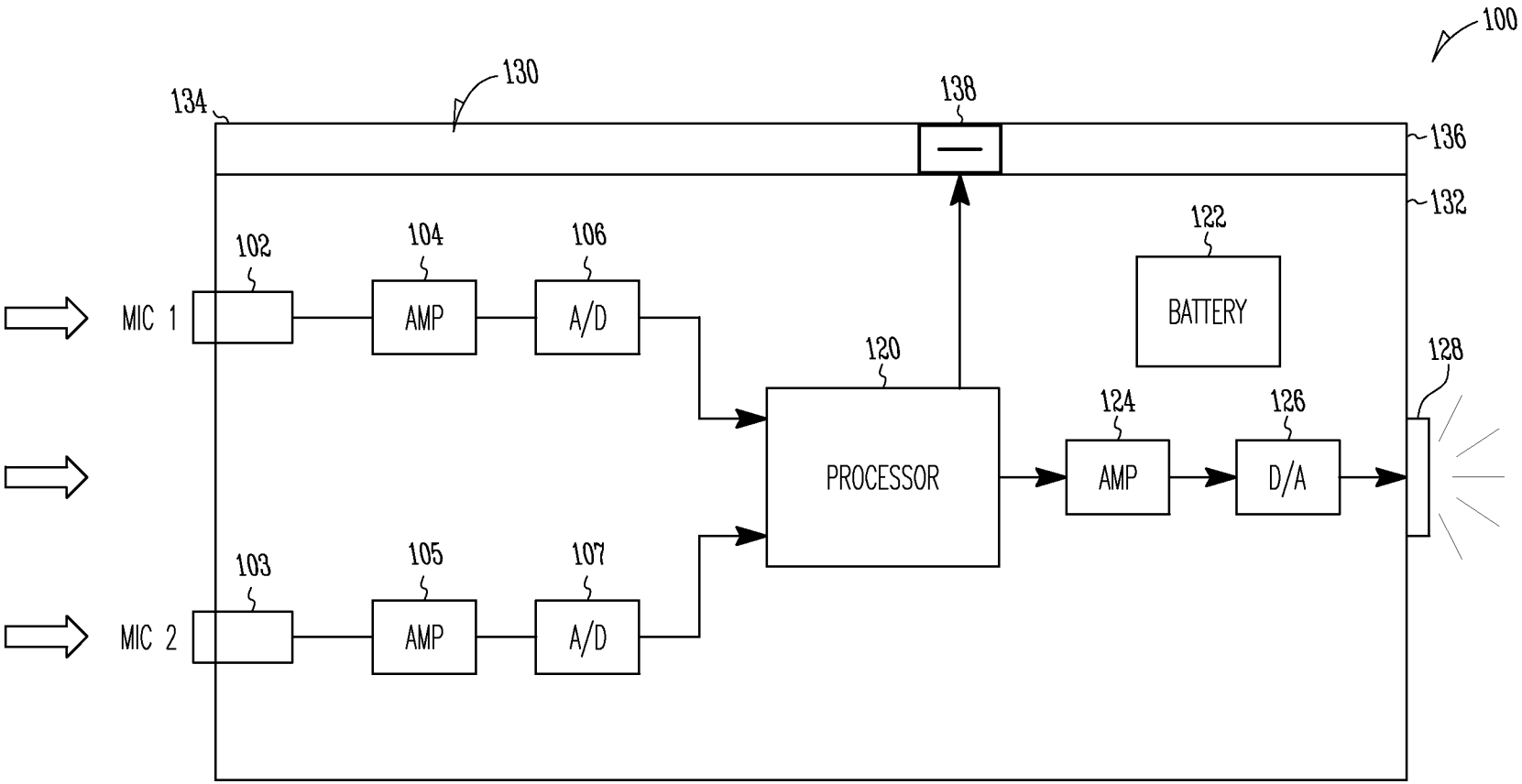
FIG. 1 is a block diagram of a hearing assistance device, according to one example of this disclosure.

FIG. 1 shows a block diagram of an example of a hearing assistance device for providing sound to an ear canal of a user in accordance with this disclosure. In one example, hearing assistance device 100 is a hearing aid. In one example, mic 1 102 is an omnidirectional microphone connected to amplifier 104 that provides signals to analog-to-digital converter 106 ("A/D converter"). The sampled signals are sent to processor 120 that processes the digital samples and provides them to amplifier 124. The amplified digital signals are then converted to analog by the digital-to-analog converter 126 ("D/A converter"). Once the signals are digital, audio sound can be played by receiver 128 (also known as a speaker). Although FIG. 1 shows amplifier 124 and D/A converter 126 and receiver 128, it is understood that other outputs of the digital information may be provided. For instance, in one example implementation, the digital data is sent to another device configured to receive it. For example, the data may be sent as streaming packets to another device that is compatible with packetized communications. In one example, the digital output is transmitted via digital radio transmissions. In one example, the digital radio transmissions are packetized and adapted to be compatible with a standard. Thus, the present subject matter is demonstrated, but not intended to be limited, by the arrangement of FIG. 1.

In one example, mic 2 103 is a directional microphone connected to amplifier 105 that provides signals to analog-to-digital converter 107 ("A/D converter"). The samples from A/D converter 107 are received by processor 120 for processing. In one example, mic 2 103 is another omnidirectional microphone. In such examples, directionality is controllable via phasing mic 1 and mic 2. In one example, mic 1 is a directional microphone with an omnidirectional setting. In one example, the gain on mic 2 is reduced so that the system 100 is effectively a single microphone system. In one example, (not shown) system 100 only has one microphone. Other variations are possible that are within the principles set forth herein.

Hearing assistance device 100 can further include a rechargeable battery 122. The battery 122 can provide operating power to various components of the hearing assistance device 100.

Hearing assistance device 100 can further include a vent structure 130 (also referred to in this disclosure as "vent 130") and a device housing 132 that defines the vent structure 130. In one example, the device housing 132 is configured to be worn at least partially in the ear canal of the user. The vent structure can extend from a first portion 134 of the device housing (or "shell") 132 to a second portion 136 of the device housing 132, defined by device housing 132. Although the example vent structure 130 in FIG. 1 is depicted as being straight, the disclosure is not so limited. Rather, in some implementations, the device housing 132 can define a vent structure 130 having a curvilinear shape. In addition, although the example vent structure 130 in FIG. 1 is depicted as having a substantially continuous cross-sectional area along its length, in some examples, the cross-sectional area can vary from the first portion 134 to the second portion 136.

Further, the techniques of this disclosure are not limited to configurations in which the first portion 134 of the vent structure 130 corresponds to the side of the device housing 132 that includes mic 1 102 and mic 2 103. Nor are the techniques of this disclosure limited to configurations in which the second portion 136 of the vent structure 130 corresponds to the side of the device housing 132 that includes receiver 128.

As mentioned above, the vent structure 130 can help reduce the occlusion effects that may result from the placement of the hearing assistance device 100 within the user's ear canal. In addition, hearing assistance device 100 can include a vent valve (or "valve") 138 that can be opened or closed (either completely or partially) as needed to enhance the user's hearing experience, e.g., when listening to music. More particularly, as described in more detail below, the vent valve 138 can be opened or closed via signals controlled by the processor 120, as described in more detail below with respect to FIGS. 6A and 6B.

In accordance with various techniques of this disclosure, the vent valve 138 can be a self-balancing valve, e.g., a butterfly valve, to reduce the power consumption of the device. It is desirable to operate a valve such that energy is only supplied to the valve when the valve is moved to from a first state, e.g., open position, to a second state, e.g., closed position. Once in position, the valve should be "bi-stable." That is, no energy is expended to hold the valve in position. As described in more detail below, a magnetic "catch" pin, for example, can be used to latch the valve in position. The magnetic catch pin can be used to create a zero power mechanism to hold or "latch" the valve in the open/closed position. The orientation between a magnet and the catch pin is such that magnetic attraction holds the valve in either a first state, e.g., open position, or a second state, e.g., closed position.

Figure 2:
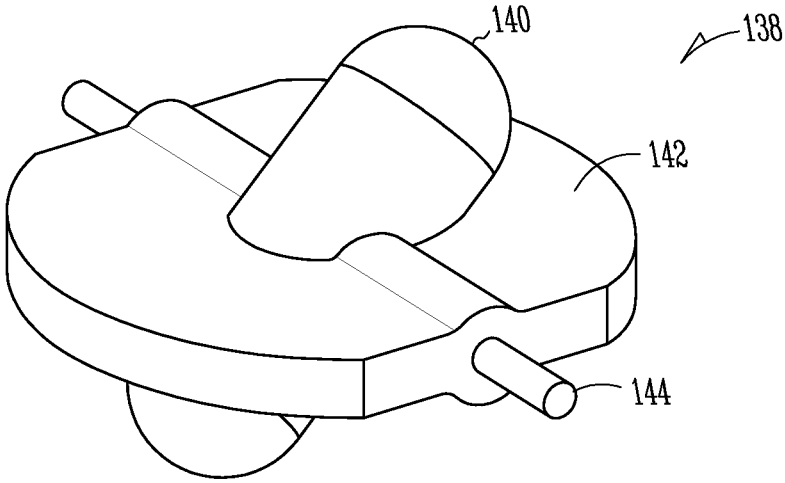
FIG. 2 is a perspective view of an example valve that may be used to implement various techniques of this disclosure.

FIG. 2 is a perspective view of an example vent valve, shown generally at 138, that may be used to implement various techniques of this disclosure. The example valve 138 is depicted as butterfly valve. A butterfly valve is inherently "self-balancing." That is, gravity does not ideally influence the valve, whether in open or closed positions, which is important because of the limited energy available for actuation and the need to minimize the effects of gravity. The techniques of this disclosure, however, are not limited to the use of butterfly valve.

The valve 138 of FIG. 2 includes a magnet 140, e.g., a permanent magnet, and a disk 142. Interaction between the magnet 140 and an applied magnetic field (not shown in FIG. 2) causes the disk 142 to move, e.g., rotate, about an axis, e.g., disk axle 144, and into the valve's open or closed position.

Figure 3A:
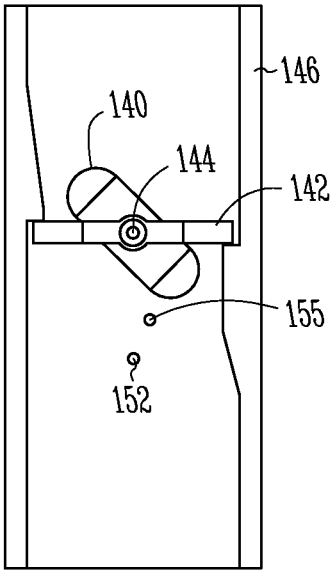
FIGS. 3A and 3B depict the example valve of FIG. 2 in a closed position within a valve housing.
Figure 3B:
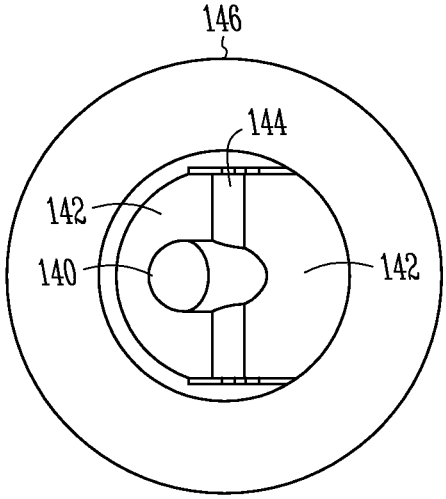

FIGS. 3A and 3B depict the example valve 138 of FIG. 2 in a closed position within a valve housing. FIG. 3A is a partial cross-sectional top view of the example vent valve 138 within a valve housing 146. FIG. 3B is a partial cross-sectional end view of the example valve 138 within the valve housing 146. Upon application of an external magnetic field, the magnet 140 of the valve 138 can rotate about the disk axle 144, thereby causing the disk 142 to rotate from an open position to the closed position depicted in FIGS. 3A and 3B. In this manner, the vent 130 (FIG. 1) of the hearing assistance device can be closed.

Figure 4A:
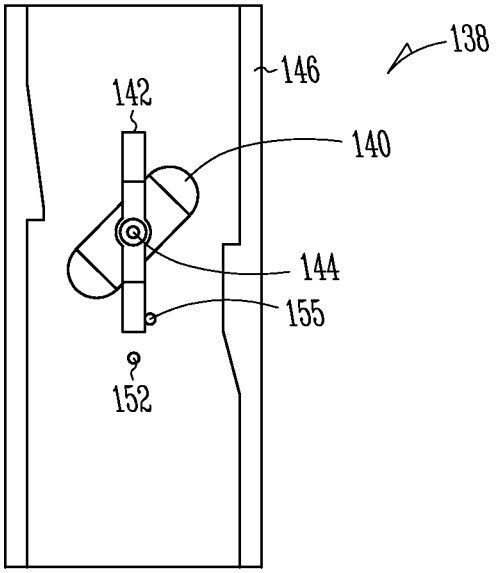
FIGS. 4A and 4B depict the example valve of FIG. 2 in an open position within a valve housing.
Figure 4B:
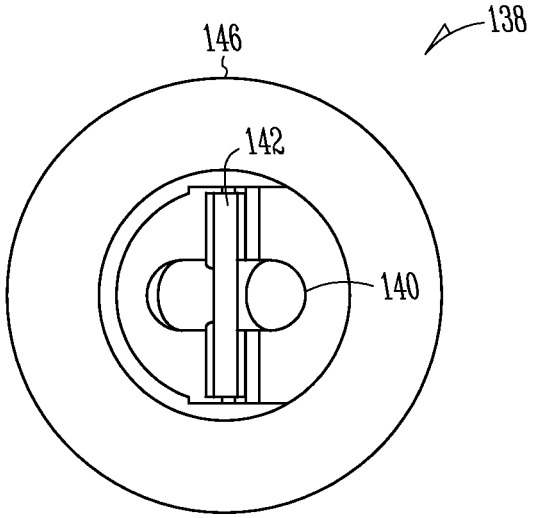

FIGS. 4A and 4B depict the example valve 138 of FIG. 2 in an open position within a valve housing. FIG. 4A is a partial cross-sectional top view of the example valve 138 within the valve housing 146. FIG. 4B is a partial cross-sectional end view of the example valve 138 within the valve housing 146. Upon application of an external magnetic field, the magnet 140 of the valve 138 can rotate about the disk axle 144, thereby causing the disk 142 to rotate from a closed position to the open position depicted in FIGS. 4A and 4B. In this manner, the vent 130 (FIG. 1) of the hearing assistance device can be opened.

Figure 5:
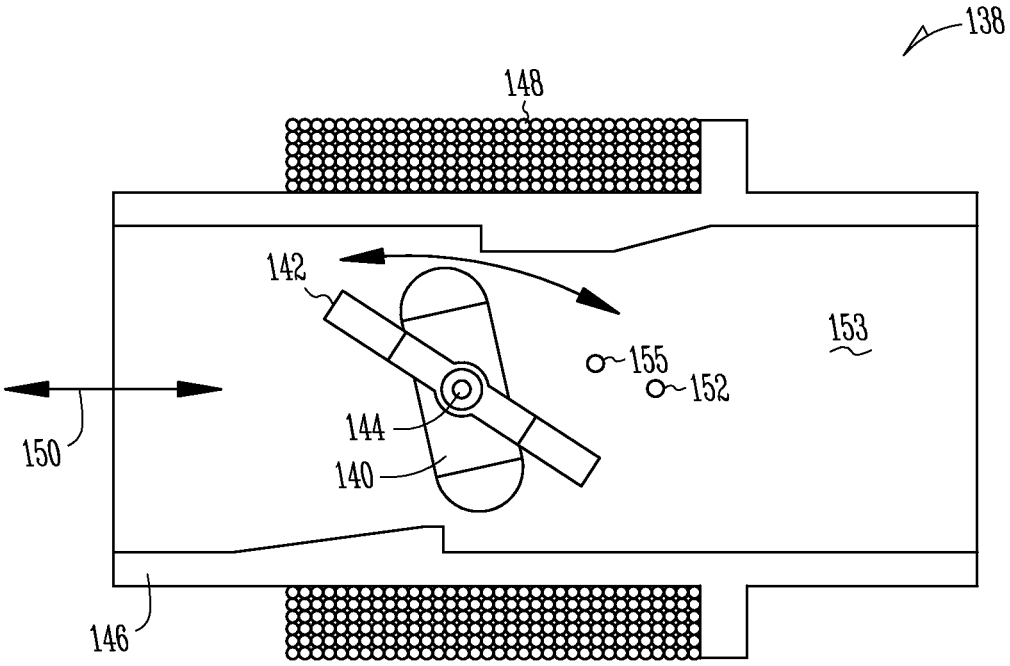
FIG. 5 is a partial cross-sectional view of an example valve in a valve housing in combination with a valve coil, in accordance with this disclosure.

FIG. 5 is a partial cross-sectional view of the example valve 138 and the valve housing 146 of FIGS. 3A-4B in combination with an actuator 148, in accordance with this disclosure. In some examples, the actuator 148 can be a coil, as depicted in FIG. 5. In other example implementations, the actuator 148 can be an electroactive polymer, a shape memory alloy, piezoelectric element, or a flexible polymer that comprises magnetic material, for example. These actuator implementations may or may not require the valve element 138 to operate. The actuator 148 (also referred to as in this disclosure as "valve coil 148") may be disposed adjacent at least a portion of the valve housing 146. To control opening and closing of the valve 138, the processor 120 (FIG. 1) is configured to apply or provide one or more signals, e.g., voltage signals, to the actuator, e.g., valve coil 148 of FIG. 5, to cause the disk to move to controllably adjust occlusion of the vent structure 130. In one example implementation, the processor 120 (FIG. 1) includes two or more general purpose input/output pins (GPIO) pins that the processor 120 can control to apply a voltage, e.g., 2 volts, to the valve coil 148, as shown and described in more detail below with respect to FIGS. 6A and 6B.

The voltage applied by the processor 120 results in a current that produces a magnetic field and thus, a valve coil polarization as indicated by arrow 150 in FIG. 5. A particular valve coil polarization 150 can either hold the magnet 140 in its present position or can cause the magnet 140 to rotate as the magnet 140 tries to align itself with the valve coil polarization 150. The rotation of magnet 140, in turn, causes the valve disk 142 to rotate, thereby opening or closing the valve 138. It is desirable that the polarity of the valve coil 148 and the polarity of the magnet 140 be coordinated in order to effectively seal or open the valve 138. In some example configurations, the valve coil 148 can have the following electrical characteristics: a resistance (R) approximately equal to 800 ohms, an inductance (L) approximately equal to 25 millihenries (mH), a number of turns (N) approximately equal to 2000 turns of 47 AWG conductor, and a corner frequency of approximately 100 Hertz.

As mentioned above, it is desirable to operate the valve 138 such that energy is only supplied to the valve 138 when the valve 138 is moved to a new position, e.g., from an open position to a closed position. Once in position, it is desirable that the valve be "bi-stable." That is, no energy is expended to hold the valve 138 in position.

In accordance with this disclosure, a magnetic catch pin 152, for example, can be used to latch the valve 138 in position. In some examples, the magnetic catch pin 152 can be made from a magnetically permeable material. The magnetic catch pin 152, which can be positioned at least partially within an interior 153 of the valve housing 146, can create a zero power mechanism to hold or "latch" the valve 138 in the open/closed position. The orientation between the magnet 140 and the catch pin 152 is such that magnetic attraction between the magnet 140 and the catch pin 152 holds the valve 138 in the open or closed position. In this manner, no energy is expended holding the valve 138 in position.

In some examples, the valve 138 can further include a stop pin 155 in the valve housing 146. Stop pin 155 can prevent the "open" voltage signal, e.g., pulse, from incorrectly changing the valve from the open position to a closed position, and likewise, the "closed" voltage pulse cannot change the valve position from the closed position to the open position.

Figure 6A:
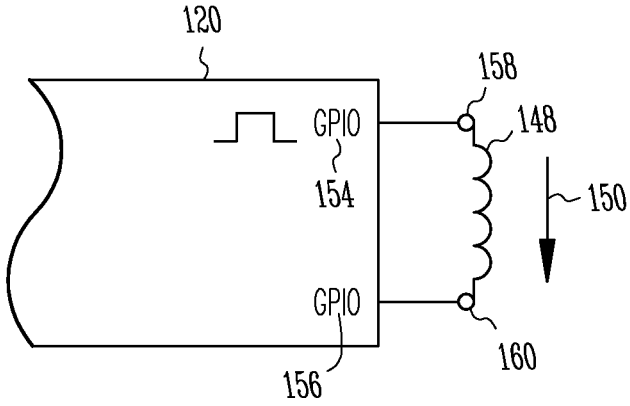
FIGS. 6A and 6B are conceptual diagrams depicting an example valve coil activation technique, in accordance with this disclosure.
Figure 6B:
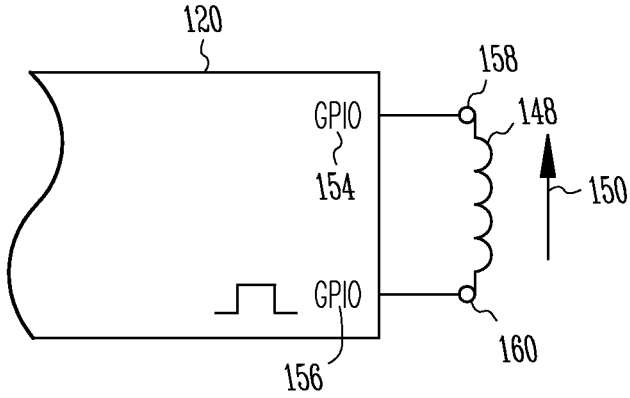

FIGS. 6A and 6B are conceptual diagrams depicting an example valve coil activation technique, in accordance with this disclosure. In one example implementation, the processor 120 (FIG. 1) includes two or more general purpose input/output pins (GPIO) pins that the processor 120 can control to apply a voltage to the valve coil 148. In FIG. 6A, the processor 120 includes two GPIO pins, namely GPIO pins 154, 156, which connect to first and second terminals 158, 160 of the valve coil 148. To close the valve, for example, the processor 120 applies a voltage to GPIO pin 154, which results in a valve coil polarization having a polarity 150. As described above with respect to FIG. 5, the change in valve coil polarization 150 causes the valve magnet 140 (FIG. 5) to rotate as the magnet 140 tries to align with the valve coil polarization 150. The rotation of magnet 140, in turn, causes the valve disk 142 to rotate, thereby closing the valve 138, for example.

Referring to FIG. 6B, in order to open the valve, for example, the processor 120 applies a voltage to GPIO pin 156, which results in a valve coil polarization having a polarity 150 that is opposite to the polarity 150 of FIG. 6A. The change in valve coil polarization causes the valve magnet 140 (FIG. 5) to rotate as the magnet 140 tries to align with the valve coil polarization 150. The rotation of magnet 140, in turn, causes the valve disk 142 to rotate, thereby opening the valve 138, for example.

In some implementations, it may be desirable to have increased valve torque. As described below with respect to FIGS. 7A and 7B, a magnetic core, e.g., with a more efficient magnetic structure in which the magnetic flux lines can be better controlled, can increase the efficiency of the device.

Figure 7A:
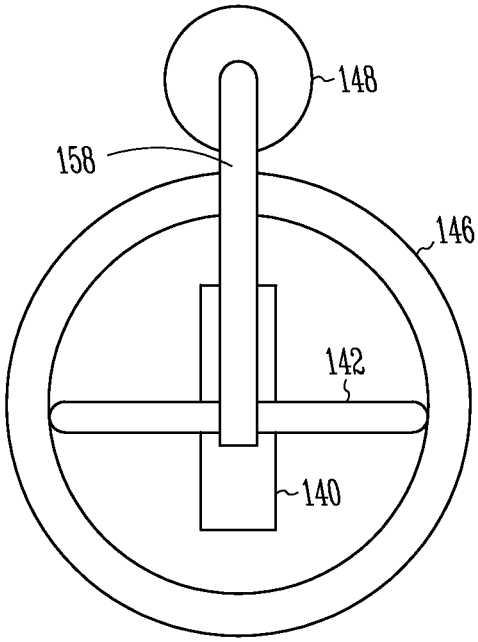
FIGS. 7A and 7B depict an example valve configuration that includes the valve and valve coil combination of FIG. 5 in further combination with a magnetic core, in accordance with this disclosure.
Figure 7B:
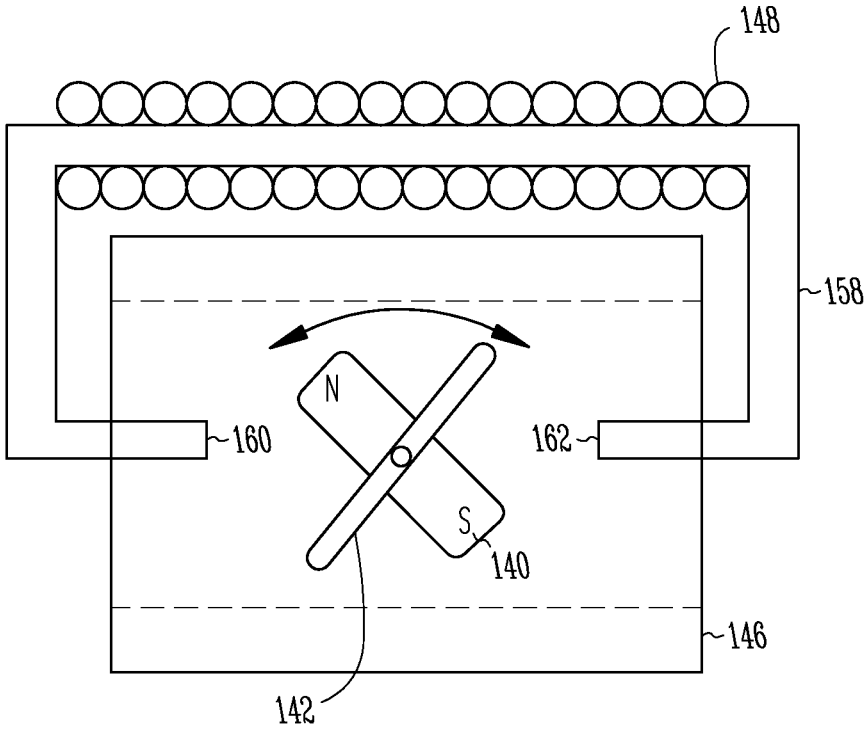

FIGS. 7A and 7B depict an example valve configuration that includes the valve and valve coil combination of FIG. 5 in further combination with a magnetically permeable core, in accordance with this disclosure. FIG. 7A is a partial cross-sectional end view depicting a magnet 140 and a disk 142 of a valve, a valve housing 146, and a magnetically permeable core 158 over which a coil 148 is disposed. FIG. 7B is a partial cross-sectional side view depicting the magnet 140, the disk 142, the valve housing 146, and the magnetically permeable core 158 of FIG. 7A.

By adding the magnetically permeable core 158, the efficiency of the valve can be increased. This, in turn, has the benefit of increasing the valve torque. Instead of, or in addition to, using a magnetic catch pin, the example configuration of FIGS. 7A and 7B, provide a magnetic catch via a first and second core ends 160, 162. The placement of the core ends 160, 162 provide the latching function in order to hold the valve in an open or closed position via magnetic attraction between the magnet 140 and the core ends 160, 162.

Regarding detecting a valve position, e.g., an open or closed position, there are several detection techniques that could be used. In some example implementations, no sensing is necessary. If a valve inadvertently changes state, a voltage pulse from the processor 120 (FIG. 1) that corresponds to an open or closed valve position can be issued periodically to place the valve back into the desired position. As described above, a stop pin (shown at 155 in FIGS. 3A, 4A, and 5) in the valve housing 146 prevent the "open" voltage signal, e.g., pulse, from incorrectly changing the valve from the open position to a closed position, and likewise, the "closed" voltage pulse cannot change the valve position from the closed position to the open position.

In other example implementations, sensing can be utilized to detect a valve position. For example, magnetic sensors, e.g., Hall, giant magnetoresistance (GMR), tunnel magnetoresistance (TMR), can be used to measure magnet/valve position. In another example, optical sensors can be used to detect the position of the valve. In yet another example, back electromotive force (EMF) can be used to detect the position of the valve. In yet another example, one or more microphones of the hearing assistance device can detect the position of the valve.

It should be noted that a landline phone may represent the strongest static magnetic field that a typical person can experience. If the magnetic catch, e.g., via the magnetic catch pin or the core ends of a magnetic core, within the valve is not configured to hold the valve position strongly, then, depending on a handset magnet polarity, the valve can flip positions. A strong "catch" and possibly the use of magnetic shielding can eliminate this concern.

With any catch mechanism, a certain amount of energy is needed to overcome a latched condition. This may mean that less energy is available for rotating or moving a given valve. As such, it may be desirable to add more reliability to valve switching. In accordance with this disclosure, a voltage multiplication circuit can be incorporated into the valve design to increase reliability, as described below with respect to FIG. 8

Figure 8:
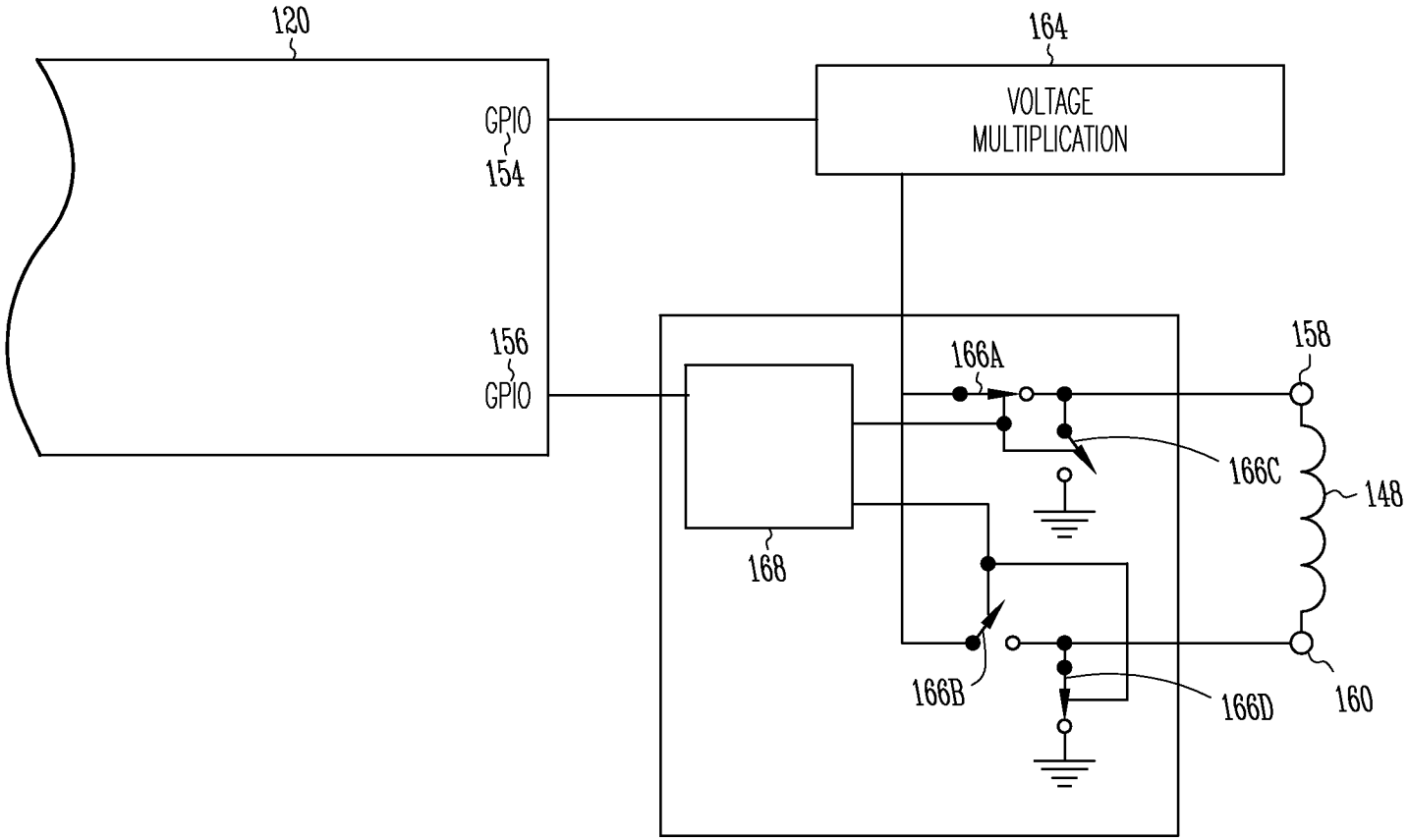
FIG. 8 is a schematic diagram depicting an example voltage multiplication circuit, in accordance with this disclosure.

FIG. 8 is a schematic diagram depicting an example voltage multiplication circuit, in accordance with this disclosure. More particularly, FIG. 8 depicts an example valve coil activation technique that incorporates a voltage multiplication circuit 164. In the example configuration of FIG. 8, the processor 120 (FIG. 1) includes two GPIO pins, namely GPIO pins 154, 156. The GPIO pin 154 is connected to the voltage multiplication circuit 164 that, in turn, is connected to first and second terminals 158, 160 of the valve coil 148 via switches 166A, 166B. The voltage multiplication circuit 164, e.g., a capacitive or inductive multiplication circuit, increases the amplitude of the voltage signal supplied by the processor 120 (via the GPIO pin 154) to the valve coil 148, e.g., from 2 volts to 5 volts. The GPIO pin 156 is connected to a switching logic circuit 168 that controls operation of the switches 166A-166D. The logic level applied by the processor 120 via the GPIO pin 156 controls the valve coil polarization (or polarity) and, thus, the direction of rotation of the magnet of the valve. For example, a low logic level, e.g., 0 volts, can correspond to an open valve, e.g., first state, and a high logic level, e.g., 2 volts, can correspond to a closed valve, e.g., second state.

A good acoustic seal between the shell of the hearing assistance device and the ear canal can improve valve performance, e.g., by reducing or eliminating acoustic shunts and/or leakage around the valve. In accordance with this disclosure, various techniques can be used to achieve a good acoustic seal. One example is described below with respect to FIG. 9.

Figure 9:
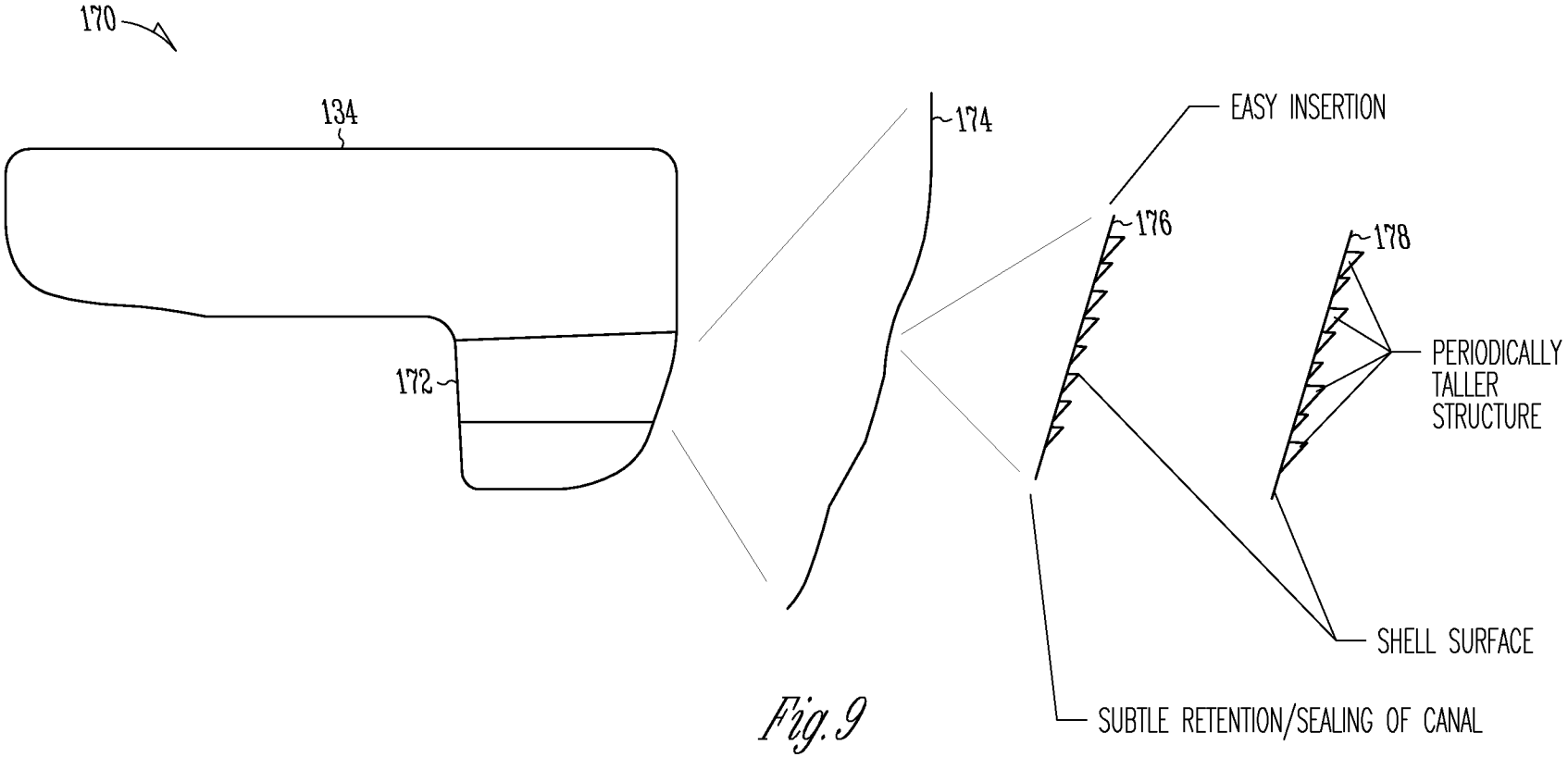
FIG. 9 is a conceptual diagram illustrating a technique for sealing an earmold, relative to the ear canal, in accordance with this disclosure.

FIG. 9 is a conceptual diagram illustrating a technique for sealing an earmold, relative to the ear canal, in accordance with this disclosure. FIG. 9 depicts an example hearing assistance device, shown generally at 170, that includes a shell 132 and a seal area 172. Using various techniques, e.g., Stereo Lithography (SLA) manufacturing techniques, shell features can be created to provide an improved seal between the shell and the ear canal. For example, SLA techniques can be used to create a textured shell area or miniature ring structures. In one example configuration, the shell surface 174 can include a plurality of ridges 176, e.g., having a height less than about 0.020 inches (20 mil), that are substantially similar in height. In another example configuration, the shell surface 174 can include a plurality of ridges 178 that vary in height, e.g. periodically. The ridges 174, 178 can provide subtle retention of the hearing assistance device within the ear canal and sealing of the ear canal.

Other techniques can be used to achieve a good acoustic seal. For example, expandable polymers that are actuated by electrical or thermal stimulation can be used. As another example, various gaskets can be used, e.g., "O" rings, spirals, and the like.

In accordance with this disclosure, SLA manufacturing methods can also be used to minimize vent space requirements. SLA methods can allow the vent to be placed in line with the valve in a straight forward manner. A slight "press" fit or adhesives can be used to achieve an air tight seal between valve and vent. SLA methods can allow for non-circular vent shapes that can further reduce space constraints, particularly in the speaker area of vent, as described below with respect to FIGS. 10A and 10B.

Figure 10A:
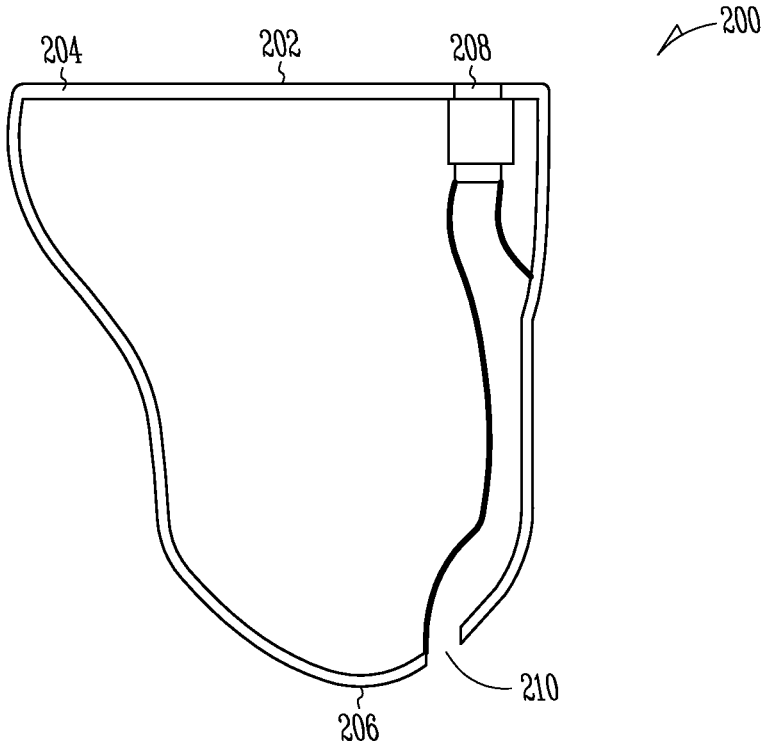
FIGS. 10A-10C are conceptual diagrams depicting an example vent of a hearing assistance device, in accordance with this disclosure.
Figure 10B:
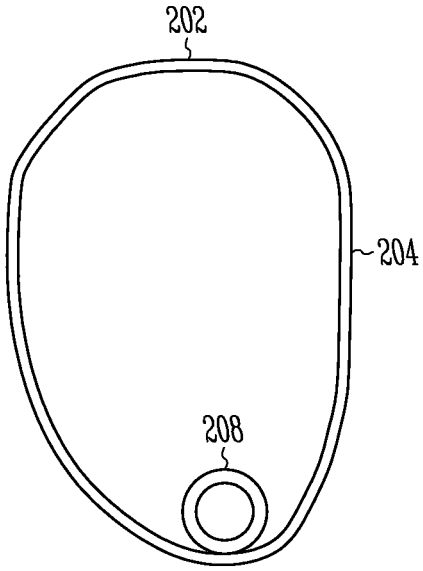
Figure 10C:
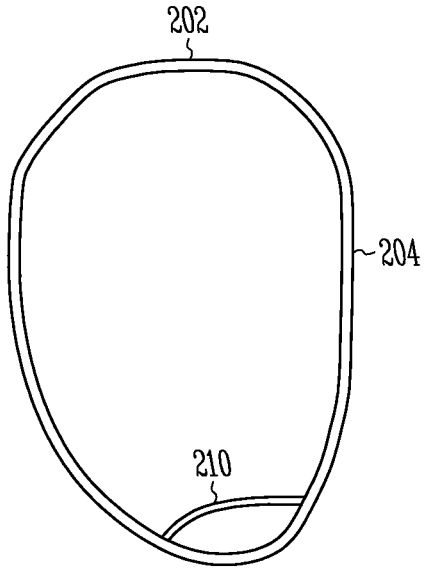

FIGS. 10A-10C are conceptual diagrams depicting an example vent of a hearing assistance device, in accordance with this disclosure. FIG. 10A is a partial cross-sectional side view of an example hearing assistance device, shown generally at 200. The hearing assistance device 200 includes a shell 202 having a first end 204 and a second end 206, a vent 208, and a non-circular vent 210 formed by SLA techniques.

FIG. 10B is a cross-sectional view of end view from the first end 204 of the shell 202 of FIG. 10A. As seen in FIG. 10B, the vent 208 can have a circular shape at the first end 204.

FIG. 10C is a cross-sectional view of end view from the second end 206 of the shell 202 of FIG. 10A. As seen in FIG. 10C, the vent can have a non-circular shape at the second end. As such, the vent 210 can have a lower profile than the vent 208 of FIG. 10B. The lower profile can save space.

The valve and valve coil described above, e.g., the valve coil 148 of FIG. 5, can provide additional functionality. As described in more detail below, the valve coil can be used for the following example implementations: an inductive recharge coil, as an radio-frequency identification (RFID) system secondary coil, automatic real-ear measurements (REM), assisting in feedback cancellation, as a low frequency inductive ear-to-ear link, and as an alternate aural indicator.

Figure 11:
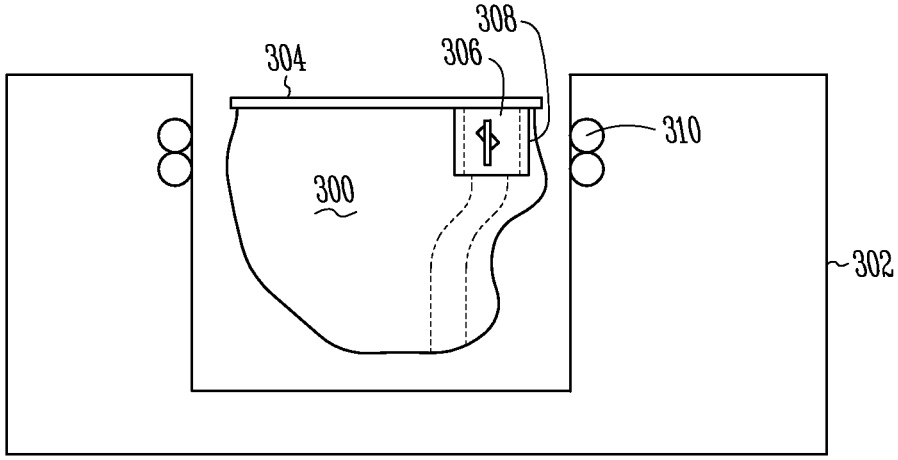
FIG. 11 is a conceptual diagram depicting a valve coil of a hearing assistance device functioning as an inductive recharge coil, in accordance with this disclosure.

FIG. 11 is a conceptual diagram depicting a valve coil of a hearing assistance device functioning as an inductive recharge coil, in accordance with this disclosure. In FIG. 11, the hearing assistance device 300 is positioned in a recharging base 302. The hearing assistance device 300 includes an ear piece 304, a valve 306, and a valve coil 308. The recharging base 302 includes a recharger primary coil 310 for inductively recharging a battery, e.g., battery 122 of FIG. 1, of the hearing assistance device 300 via the valve coil 308. Since the valve 306 can be consistently placed in the ear piece 304 and, in turn, the ear piece 304 can be consistently placed in the recharging base 302, good coil alignment can be maintained to allow inductive recharging using the valve coil as a secondary coil.

Figure 12:
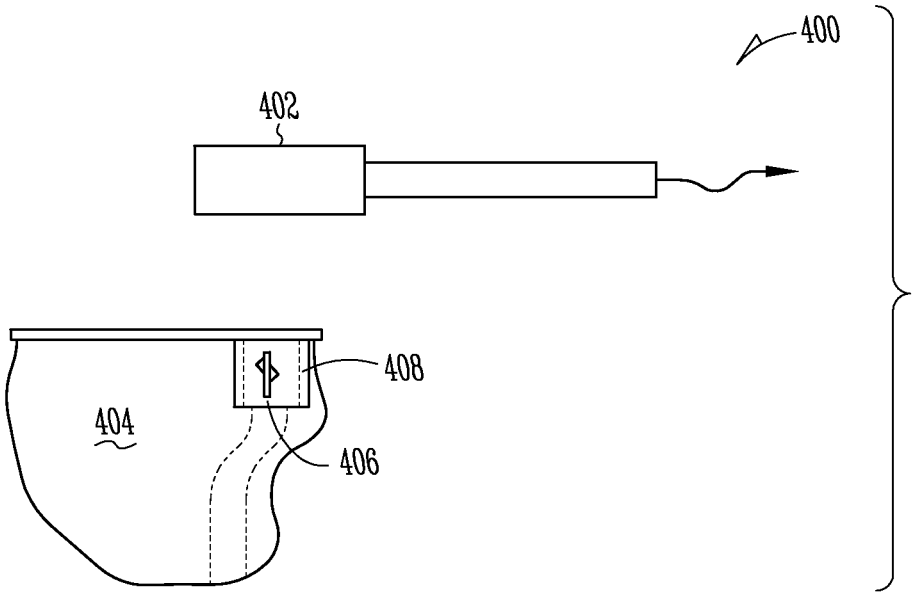
FIG. 12 is a conceptual diagram depicting an RFID system that utilizes a valve coil of a hearing assistance device, in accordance with this disclosure.

FIG. 12 is a conceptual diagram depicting an RFID system that utilizes a valve coil of a hearing assistance device, in accordance with this disclosure. The RFID system, shown generally at 400, includes an RFID reader 402, a hearing assistance device 404, a valve 406, and a valve coil 408. The valve coil 408 can be used as an RFID system secondary coil. Example uses include inventory control and loading data into a memory of the hearing assistance device 404.

Figure 13:
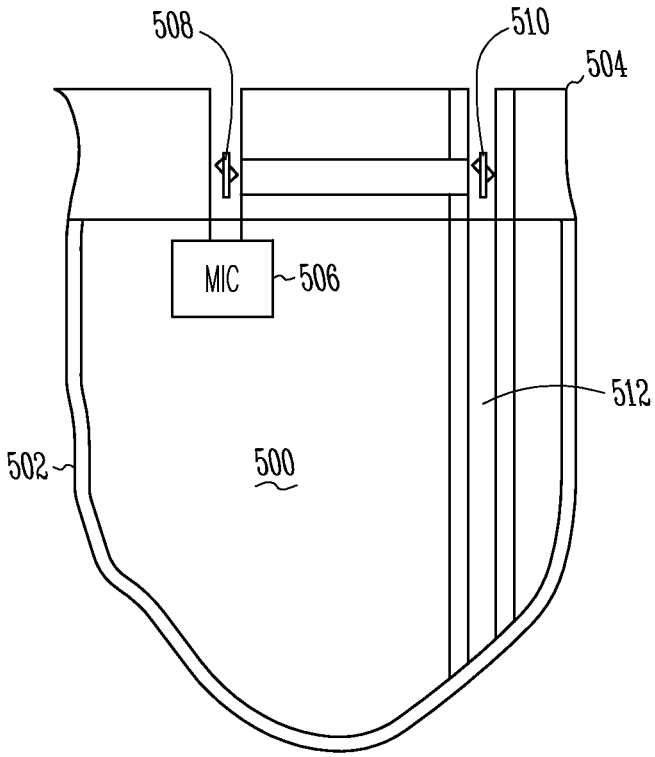
FIG. 13 is a conceptual diagram depicting an example hearing assistance device that utilizes a miniature valve for automatic real-ear measurements (REM).

FIG. 13 is a conceptual diagram depicting an example hearing assistance device that utilizes a miniature valve for automatic real-ear measurements (REM). The hearing assistance device 500 of FIG. 13 includes a shell 502, a top plate 504, a microphone 506, first and second valves 508, 510, and a vent tube 512. An automatic REM measuring scheme can be created by using compact first and second valves 508, 510. This can allow REM to be taken as a routine part of a patient visit without requiring additional equipment and work by an audiologist. By placing the first and second valves 508, 510 in the appropriate open/closed state(s), a microphone port can be routed into the ear canal for REM. In normal operation, the valves can be positioned in order to allow the mic port to access the ambient acoustic environment and vent bore to couple the ambient environment to the residual canal volume. For REM, first and second valves 508, 510 can block access to the environment, thereby allowing the mic port to directly access canal residual volume.

Figure 14:
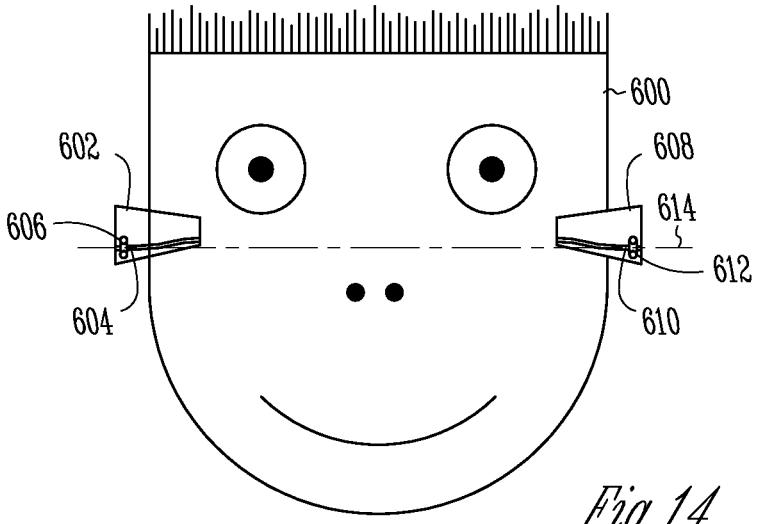
FIG. 14 is a conceptual diagram depicting a user wearing two hearing assistance devices that include valve coils that can provide an ear-to-ear link, in accordance with this disclosure.

FIG. 14 is a conceptual diagram depicting a user wearing two hearing assistance devices that include valve coils that can provide an ear-to-ear link, in accordance with this disclosure. The user 600 is wearing a first hearing assistance device 602 that can include a first vent 604 and a first vent valve (and coil) 606, and a second hearing assistance device 608 that can include a second vent 610 and a second vent valve (and coil) 612. Line 614 depicts an ideally aligned center line.

If the vent valves 606, 612 are attached to their respective top plates (not depicted), an ideal coil alignment is created between both ears of the user, which can be used for ear-to-ear inductive communications. With the push for higher frequency radiofrequency (RF) links in hearing assistance devices, which results in smaller antennas, data rates, and international homologation, for example, shadow effects can become more pronounced and may prohibit high frequency RF from ear-to-ear communications. As such, it may be desirable to use "hybrid" schemes for hearing assistance device communications, e.g., an RF link for streamer applications, and wireless programming, etc., and an inductive link for ear-to-ear control signaling and data transfer.

There are many ways in which the zero power "holding" feature described herein can be implemented. In some example configurations, the holding feature is constructed using magnetized materials. In some example configurations, the holding feature is not located within the valve itself, as described below with respect to FIG. 15.

Figure 15:
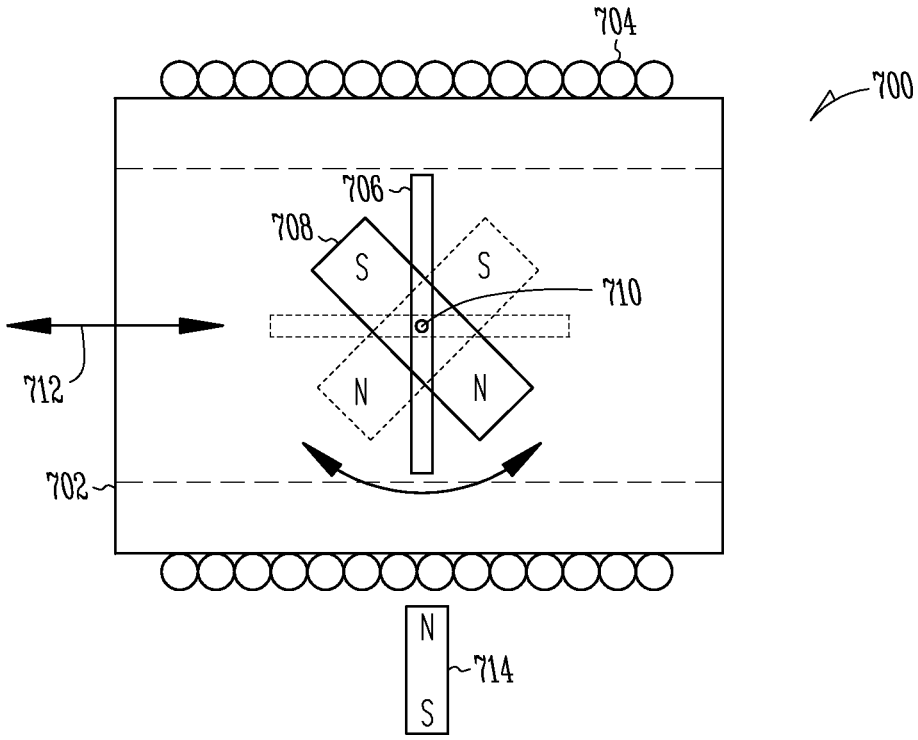
FIG. 15 is a partial cross-sectional view of an example valve in a valve housing in combination with an actuator, in accordance with this disclosure.

FIG. 15 is a partial cross-sectional view of an example valve 700 in a valve housing 702 in combination with an actuator 704, in accordance with this disclosure. In some examples, the actuator 704 includes a coil, as shown in FIG. 15. In some embodiments, the valve 700 further includes a valve disk 706, a valve magnet 708, and a disk axle 710. To control opening and closing of the valve 700, the processor 120 (FIG. 1) is configured to apply or provide one or more signals, e.g., voltage signals, to the actuator, e.g., coil 704 of FIG. 15, thereby causing the disk 706 to rotate from an open position to the closed position. The voltage applied by the processor 120 results in a current that produces a magnetic field and thus, a valve coil polarization as indicated by arrow 712 in FIG. 15. The control signals described above with respect to FIG. 5 may be employed for control in this application.

FIG. 15 depicts an alternative latching configuration. Rather than use a magnetic catch pin, e.g., pin 152 of FIG. 5, the valve 700 of FIG. 15 uses a latching magnet 714 to hold the valve 700 in an open or closed position. In the example configuration of FIG. 15, the latching magnet 714 is external to the valve housing 702. The opposing magnetic poles of the valve magnetic 708 and the latching magnet 714 push the valve from one position, e.g., open, to the other, e.g., closed.

In some example implementations, a valve, as described in this disclosure, can be used to assist with feedback suppression. Under high gain conditions, closing the valve can assist a feedback canceller to reduce or eliminate feedback.

In another example implementation, a valve, as described in this disclosure, can be used as alternate aural indicator. Because the valve can cycle in less than 20 msec, a 50 Hertz (Hz) to 60 Hz "buzzing" sound could be created. This "buzz" can be used as an alternative notification, different from speaker generated "beeps" and voice cues.

Alternative actuators can be used to actuate a valve instead of or in addition to the techniques described above. For example, electroactive polymers (EAP), shape memory alloys (SMA), piezoelectric elements, and flexible polymers saturated with magnetic material can be used to actuate a valve in a hearing assistance device. EAP material can be configured either as a filament or as a bendable element, for example. In filament form, the strain from the EAP material can be made to act on a valve structure to rotate or translationally move a valve structure. In a two-dimensional configuration, the EAP material can be configured to bend and act directly as the valve's sealing element. SMA, in wire form, can be made to convey strain directly to the valve's sealing element by rotating or translating a sealing element. Magnetic material saturated polymers can be used as the sealing element (valve) that is acted upon by a magnetic field to move in a desired way.

Using various techniques of this disclosure described above, a self-balancing valve can be included within the vent of a hearing assistance to reduce the power consumption of the device. These techniques are in contrast to many existing hearing assistance device. For example, U.S. Patent Application Publication No. 2010/0014696 to Boschung et al. discusses several techniques for opening and closing a valve. However, U.S. Patent Application Publication No. 2010/0014696 does not describe how to hold the valve in position once it is moved to a new position, which implies that power is consumed to hold the valve in position. As another example, U.S. Pat. No. 6,549,635 to Gebert, like U.S. 2010/0014696, also does not mention how to latch or hold a valve of a hearing assistance device in a given position without consuming power.

The techniques described above can provide several benefits. Some benefits may include enhanced music appreciation, telephone usage improvement, e.g., noise, low end extension, noise reduction, e.g., close in noisy environments, feedback reduction, real ear measurement (REM), ear-to-ear communications, inductive recharge, or RFID capability.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using sub-band processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers located in the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

The invention claimed is:

1. A hearing assistance device for providing sound to an ear canal of a user, comprising:

a device housing configured to be worn at least partially in the ear canal of the user, the device housing defining a vent structure extending from a first portion of the housing to a second portion of the housing to provide an acoustic path for sounds to pass through the device;

a vent valve positioned within at least a portion of the vent structure, the vent valve having at least a first state and a second state, the vent valve comprising:

a magnet having a magnetic field;

a disk configured to move about an axis; and a magnetic catch configured to apply a force to the disk to hold the disk in at least one of the first state and the second state;

a coil actuator;

a processor configured to provide at least one signal to the coil actuator to cause the disk to move to controllably adjust the vent structure; and a magnetic core including a first end and a second end, wherein the coil actuator is disposed about the magnetic core, and wherein the first end of the magnetic core and the second end of the magnetic core at least partially define the magnetic catch.

2. The hearing assistance device of claim 1, wherein the magnetic catch is a magnetically permeable material that is positioned at least partially within an interior of the valve housing.

3. The hearing assistance device of claim 1, wherein the at least one signal comprises a first signal and a second signal, and wherein the processor comprises:

a first general purpose input/output pin (GPIO) pin; and a second GPIO pin, wherein providing the first signal to the actuator, via the first GPIO pin, causes the valve to transition from the first state to the second state, and wherein providing the second signal to the coil, via the second GPIO pin, causes the valve to transition from the second state to the first state.

4. The hearing assistance device of claim 1, wherein the at least one signal comprises a first signal and a second signal, wherein the processor comprises:

a first general purpose input/output pin (GPIO) pin; and a second GPIO pin, wherein the hearing assistance device further comprises:

a voltage multiplication circuit in communication with the first GPIO pin and the actuator, the voltage multiplication circuit configured to increase an amplitude of the first signal; and a switching circuit in communication with the second GPIO pin, the switching circuit configured to control the actuator via the second signal, wherein providing the second signal having a first logic level to the second GPIO pin causes the valve to transition from the first state to the second state, and wherein providing the second signal having a second logic level to the second GPIO pin causes the valve to transition from the second state to the first state.

5. The hearing assistance device of claim 1, wherein the device housing comprises a surface, and wherein a portion of the surface defines a plurality of ridges.

6. The hearing assistance device of claim 1, wherein the plurality of ridges vary in height.

7. The hearing assistance device of claim 1, wherein the device housing that defines a vent structure further defines a first end of the vent structure and a second end of the vent structure, and wherein the first end of the vent structure has a first shape, wherein the second end of the vent structure has a second shape, and wherein the second shape is different from the first shape.

8. The hearing assistance device of claim 1, further comprising:

a rechargeable battery, wherein the rechargeable battery is configured to inductively receive power and recharge via the coil actuator.

9. A method for providing sound to an ear canal of a user, comprising:

providing a hearing assistance device, the hearing assistance device comprising:

a device housing configured to be worn at least partially in the ear canal of the user, the device housing defining a vent structure extending from a first portion of the housing to a second portion of the housing to provide an acoustic path for sounds to pass through the device;

a vent valve positioned within at least a portion of the vent structure, the vent valve having at least a first state and a second state, the vent valve comprising:

a magnet having a magnetic field;

a disk configured to move about an axis; and a magnetic catch configured to apply a force to the disk to hold the disk in at least one of the first state and the second state, wherein the magnetic catch is a magnetic pin that is positioned at least partially within an interior of the valve housing;

an actuator; and a processor configured to provide at least one signal to the actuator to cause the disk to move to controllably adjust the vent structure;

providing the at least one signal to the actuator to cause the disk to move to controllably adjust the vent structure; and holding the valve in the first state or the second state, via the magnetic catch.

10. The method of claim 9, wherein holding the valve in the first state or the second state, via the magnetic catch, comprises:

holding the valve in the first state or the second state, via a magnetic pin that is positioned at least partially within an interior of the valve housing.

11. The method of claim 9, wherein the actuator is a coil.

12. The method of claim 11, wherein providing a hearing assistance device further comprises:

providing a magnetic core, wherein the coil is disposed about the magnetic core.

13. The method of claim 12, wherein providing a magnetic core further comprises:

providing a first end of the magnetic core and a second end of the magnetic core, wherein the first end of the magnetic core and the second end of the magnetic core at least partially define the magnetic catch.

14. The method of claim 9, wherein the at least one signal comprises a first signal and a second signal, and wherein the processor comprises:

a first general purpose input/output pin (GPIO) pin; and a second GPIO pin, and wherein providing the at least one signal to the actuator to cause the disk to move to controllably adjust the vent structure comprises:

providing the first signal to the actuator, via the first GPIO pin, to cause the valve to transition from the first state to the second state, and providing the second signal to the actuator, via the second GPIO pin, to cause the valve to transition from the second state to the first state.

15. The method of claim 9, wherein the at least one signal comprises a first signal and a second signal, wherein the processor comprises:

a first general purpose input/output pin (GPIO) pin; and a second GPIO pin, wherein providing a hearing assistance device further comprises:

providing a voltage multiplication circuit in communication with the first GPIO pin and the coil, the voltage multiplication circuit configured to increase an amplitude of the first signal; and providing a switching circuit in communication with the second GPIO pin, the switching circuit configured to control the coil polarization via the second signal, wherein providing the at least one signal to the actuator to cause the disk to move to controllably adjust the vent structure comprises:

providing the second signal having a first logic level to the second GPIO pin to cause the valve to transition from the first state to the second state, and providing the second signal having a second logic level to the second GPIO pin to cause the valve to transition from the second state to the first state.

16. The method of claim 9, further comprising:

defining a plurality of ridges on at least a portion of the surface of the device housing.

17. The method of claim 16, wherein defining a plurality of ridges on at least a portion of the surface of the device housing comprises:

defining a plurality of ridges that vary in height on at least a portion of the surface of the device housing.

18. The method of claim 9, wherein the device housing that defines a vent structure further defines a first end of the vent structure and a second end of the vent structure, and wherein the first end of the vent structure has a first shape, wherein the second end of the vent structure has a second shape, and wherein the second shape is different from the first shape.

19. The method of claim 9, further comprising:

inductively recharging a rechargeable battery of the hearing assistance device via a coil.

20. A hearing assistance device comprising:

a device housing configured to be worn at least partially in the ear canal of the user, the device housing defining a vent structure extending from a first portion of the housing to a second portion of the housing to provide an acoustic path for sounds to pass through the device;

a vent valve positioned within at least a portion of the vent structure, the vent valve having at least a first state and a second state, the vent valve comprising:

a magnet having a magnetic field;

a disk;

at least one disk axle about which the disk is configured to rotate;

a valve housing; and a magnetic catch;

a coil disposed adjacent the valve housing; and a processor configured to control application of at least one signal to the coil, wherein the application of the at least one signal to the coil produces a coil polarization that interacts with the magnetic field of the magnet and causes the disk to rotate about the disk axle, and wherein the magnetic catch is configured to hold the valve, via the magnet, in the first state or the second state.

* * * * *